US010214875B2

(12) United States Patent
Garramone et al.

(10) Patent No.: US 10,214,875 B2
(45) Date of Patent: Feb. 26, 2019

(54) WORKING MACHINE HAVING A HYDRAULICALLY OPERATED IMPLEMENT

(71) Applicant: CNH Industrial America LLC, New Holland, PA (US)

(72) Inventors: Adriano Garramone, Lecce (IT); Andrea Gravili, Lecce (IT); Gianpiero Negri, Mercato San Severino (IT); Giuseppina Razetto, Turin (IT); Marco Pietro Ciarrocchi, Sant'Omero (IT)

(73) Assignee: CNH Industrial America LLC, New Holland, PA (US)

( * ) Notice: Subject to any disclaimer, the term of this patent is extended or adjusted under 35 U.S.C. 154(b) by 185 days.

(21) Appl. No.: 15/123,538

(22) PCT Filed: Mar. 2, 2015

(86) PCT No.: PCT/EP2015/054252
§ 371 (c)(1),
(2) Date: Sep. 2, 2016

(87) PCT Pub. No.: WO2015/132178
PCT Pub. Date: Sep. 11, 2015

(65) Prior Publication Data

US 2017/0073924 A1 Mar. 16, 2017

(30) Foreign Application Priority Data

Mar. 3, 2014 (IT) ..... MO2014A0050

(51) Int. Cl.
*E02F 3/43* (2006.01)
*E02F 9/20* (2006.01)
(Continued)

(52) U.S. Cl.
CPC ..... *E02F 3/434* (2013.01); *E02F 3/283* (2013.01); *E02F 9/2004* (2013.01);
(Continued)

(58) Field of Classification Search
CPC ..... E02F 3/434; E02F 9/2041; E02F 9/2285; F15B 11/024; F15B 11/15; F15B 2211/67
See application file for complete search history.

(56) References Cited

U.S. PATENT DOCUMENTS 3,643,828 A * 2/1972 Elliott ..... E02F 3/434 414/347
3,726,428 A 4/1973 Lark et al.
(Continued)

FOREIGN PATENT DOCUMENTS

DE 29506195 U1 8/1996
EP 0608096 A1 7/1994

*Primary Examiner* — F. Daniel Lopez
*Assistant Examiner* — Matthew Wiblin
(74) *Attorney, Agent, or Firm* — Peter K. Zacharias; Patrick M. Sheldrake

(57) ABSTRACT

A working machine including a movable implement, a hydraulic actuator for displacing the implement, and a hydraulic control system for enabling an operator to control movement of the implement. The control system allows the implement to be returned to a desired position or state, such as a return to dig position or a return to float state, in a single automated operation that is initiated by the operator actuating a switch at the same time as moving a joystick in a desired direction. A pilot-operated valve is used to supply hydraulic fluid under pressure to the actuator acting on the implement and the operation of the joystick is detected by means of a pressure sensor connected to a control line of the pilot-operated valve.

8 Claims, 3 Drawing Sheets

(51) Int. Cl.
*E02F 9/22* (2006.01)
*E02F 3/28* (2006.01)
*F15B 13/042* (2006.01)

(52) U.S. Cl.
CPC ..... *E02F 9/2041* (2013.01); *E02F 9/2203* (2013.01); *E02F 9/2267* (2013.01); *E02F 9/2285* (2013.01); *F15B 13/0424* (2013.01); *F15B 13/0422* (2013.01); *F15B 2013/0428* (2013.01); *F15B 2211/329* (2013.01); *F15B 2211/355* (2013.01); *F15B 2211/575* (2013.01); *F15B 2211/6316* (2013.01); *F15B 2211/6336* (2013.01); *F15B 2211/6346* (2013.01); *F15B 2211/6355* (2013.01); *F15B 2211/67* (2013.01); *F15B 2211/857* (2013.01)

(56) References Cited

U.S. PATENT DOCUMENTS 3,915,325 A 10/1975 Lark et al.
4,844,685 A * 7/1989 Sagaser ..... E02F 3/43 414/699
4,934,463 A * 6/1990 Ishida ..... E02F 3/844 172/4.5
5,333,533 A * 8/1994 Hosseini ..... E02F 9/2214 60/469
5,477,770 A * 12/1995 Ono ..... E02F 3/437 91/459
5,537,818 A * 7/1996 Hosseini ..... E02F 3/434 60/327
5,685,377 A * 11/1997 Arstein ..... A01B 63/102 172/2
5,784,944 A * 7/1998 Tozawa ..... E02F 3/437 91/361
7,748,147 B2 7/2010 Schoenmaker et al.
8,132,345 B2 * 3/2012 Trifunovic ..... A01B 63/00 37/348
8,544,263 B2 10/2013 Kim
8,606,470 B2 12/2013 Nicholson et al.
2002/0073833 A1 * 6/2002 Coombs ..... E02F 3/434 91/35
2006/0263189 A1 11/2006 Vigholm
2010/0226744 A1 * 9/2010 Trifunovic ..... E02F 3/432 414/700

* cited by examiner

WORKING MACHINE HAVING A HYDRAULICALLY OPERATED IMPLEMENT

FIELD OF THE INVENTION

The present invention relates to a working machine having a movable implement, a hydraulic actuator for displacing the implement, and a hydraulic control system to enable an operator to control movement of the implement.

BACKGROUND OF THE INVENTION

Motorised vehicles are well known for use in material handling that carry an implement and have a hydraulically operated lifting arm for moving the implement. Examples of such vehicles are tractors, loaders e.g. compact wheel loaders, backhoes, excavators and forklifts.

All of such vehicles are often used to perform repetitive tasks where the hydraulically operated implement is required to return to a starting position or state. For example, in the case of a loader, the lifting arm, which is formed may comprise a system of mutually pivoted limbs, is used to support a bucket that can be tilted and moved up and down with the aid of tilting and lifting hydraulic cylinders, respectively. If the loader is used, for example, to load material from a mound resting on flat ground onto a truck, at the commencement of each loading cycle, the bucket must adopt a horizontal attitude so that it can pick up material when the vehicle is driven forwards and it should rest on the ground under the action of its own weight, so as naturally to follow the contour of the ground. Once the bucket is full, it needs to be tilted so that material does not fall out of the bucket, positioned over the truck by moving the vehicle and rotating the lifting arm and then tilted to empty its contents into the truck.

Having discharged its load into the truck, the bucket has to be returned to the position for digging and lowered to rest on the ground under its own weight. These operations need to be performed at the same time as the operator is manoeuvring the vehicle to a new position in readiness for next loading cycle. The process can be simplified significantly by enabling the implement to return to a preselected dig position (referred to herein as a "return to dig" (RTD) functionality), and enabling the lifting arm to return to a free floating state (referred to herein as a "return to float" (RTF) functionality) without requiring intervention from the operator. It is clear from the previous that these functionalities also apply to forklifts.

The closest prior art to the present invention is believed to be US2002/0073833 which discloses a return to dig system for a work machine having at least one implement that is actuated by a hydraulic cylinder using a switch, such as with a push button, to control a valve and solenoid to move the implement from a remote position to a preselected position, usually the starting position. The preselected position is determined by a sensor and a detectable element, such as a magnet. When the detectable element is sensed, the solenoid is repositioned to stop movement of the implement. The push button is located on a joystick that controls the movement of the implement and various other functions of the work machine. The actuation of the return to dig system by the push button does not affect any other unrelated function of the work machine controlled by the device.

SUMMARY OF THE INVENTION

According to the present invention, there is provided a working machine having a movable implement, a hydraulic actuator for displacing the implement, and a hydraulic control system for enable an operator to control movement of the implement, the control system comprising:

a supply line for supplying hydraulic fluid at a high pressure, a supply line for supplying hydraulic fluid at a pilot pressure lower than the high pressure, a hydraulic return line, a pilot-operated valve for selectively connecting the high pressure supply line and the return line to the hydraulic actuator to displace the implement, the valve having a spool movable by the action of the hydraulic pilot pressure, a manually operable joystick, a hydraulic pilot valve for regulating the supply of hydraulic pilot pressure to the pilot-operated valve in dependence the position of the joystick, an electrically operated valve for bypassing the pilot valve and supplying hydraulic pilot pressure to the pilot-operated valve independently of the position of the joystick, and an electrical circuit that includes a manually operable switch and that is triggered by operation of the switch to initiate a return of the implement to a predetermined state by actuation of the electrically operated valve, independently of the operation of the joystick, characterized in that a hydraulic pressure sensor is connected to a line leading from the pilot valve to the pilot-operated valve, and the electrical circuit is only triggered by operation of the manually operable switch when the pressure sensed by the sensor exceeds a predetermined value.

In some embodiments, the implement is a bucket of a loader and the hydraulic actuator serves to tilt the bucket, and actuation of the electrically operated valve serves to perform an RTD movement of the bucket.

In this case, the control system may further comprise a position sensor for sensing the position of the bucket and sending a signal to the electrical circuit to disable the electrically controlled valve when the bucket is sensed to have returned to the desired position to recommence digging.

In some embodiment, the implement is a bucket mounted on a lifting arm and the actuator is connected to the lifting arm to raise and lower the bucket. Here, actuation of the electrically operated valve serves to displace the spool of the pilot-operated valve to a position in which the arm and the bucket are allowed to float, that is to say free to fall under the action of its own weight.

In this case, a second hydraulic pressure sensor may be provided in a second line connecting a joystick operated pilot valve to the pilot-operated valve and the electrically operated valve may be disabled when the sensed pressure in the second line exceeds a predetermined value.

In common with US2002/0073833, the operator can initiate an RTD position by simply operating an electrical switch which, for convenience can be mounted on the joystick. However, in the present invention, the operator is also required to move the joystick to supply pilot pressure to the pilot-operated valve at the same time as the electrical switch is operated.

Advantageously, a further, manually operable, electrical mode switch may be connected to the electrical circuit to disable permanently actuation of the electrically operated valve. Such a switch may be mounted on a control panel to set the control system in a mode in which initiation of an RTD or an RTF operation is prevented even if the joystick mounted switch is depressed at the same time as the joystick is moved in the desired direction of movement of the bucket.

BRIEF DESCRIPTION OF THE DRAWINGS

The invention will now be described further, by way of example, with reference to the accompanying drawings, in which.

DETAILED DESCRIPTION OF THE DRAWINGS

Figure 1:
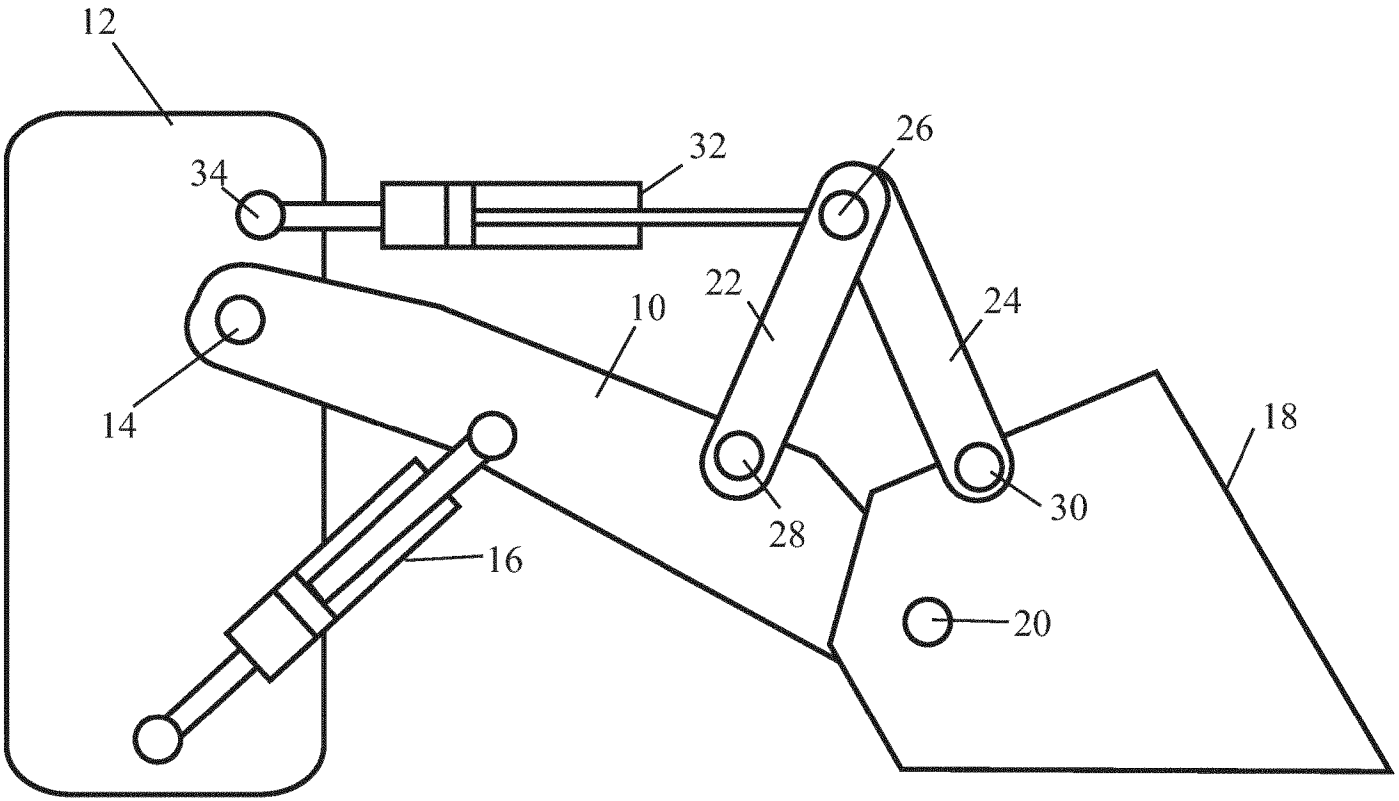
FIG. 1 is a schematic representation of a lifting arm of a loader carrying a bucket at its free end.

In FIG. 1, a lifting arm 10 is mounted on the chassis 12 of a loader for pivoting movement about a pin 14. A lifting cylinder 16 is connected between the arm 10 and the chassis 12. A bucket 18 is mounted on the free end of the lifting arm 10 and is pivotable about a pin 20. Two links 22 and 24 that pivot relative to one another about a pin 26 are pivotably connected to the arm 10 and the bucket 18 by pins 28 and 30, respectively. A tilting cylinder 32 is connected at one end to the pivot pin 26 and at its other end to a pivot pin 34 mounted on the chassis 12.

The loader shown in FIG. 1 can be used to load material from a mound on the ground into a truck. At the commencement of a loading cycle, the tilting cylinder 32 is used to position the bucket 18 in a horizontal attitude as shown in FIG. 1. Furthermore, the lifting cylinder 16 has both its working chambers connected by way of throttles to a hydraulic drain so that it acts as a damper but does not apply any lifting force to the lifting arm 10. With the bucket 18 in this position and the lifting arm 10 in this state, the loader is driven forward into the mound of material in order to fill the bucket 18.

The loader has a hydraulic control system to be described below for enabling an operator to control the movement of the bucket 18. The control system includes a joystick movable up and down to raise and lower the lifting arm 10 and from side to side to tilt the bucket up and down. Using the joystick, the operator next retracts the tilting cylinder 32 to tilt the bucket 18 counter-clockwise, as viewed in FIG. 1 and thereby prevent material from falling out of the bucket as it is moved. The lifting cylinder 16 is then extended to raise the bucket 18 above the level of the truck and at the same time the loader is moved or the lifting arm is pivoted to position the bucket vertically above the truck. At this time, the tilting cylinder 32 is extended to tilt the bucket 18 clockwise as viewed, causing its contents to drop into the truck.

After this operation has been completed, the bucket needs to be returned to its horizontal position and the lifting arm lowered. Embodiments of the present invention can be used to enable either or both of these RTD and RTF operations to the performed safely and automatically, in order to leave the operator free to concentrate on rotating the lifting arm or manoeuvring the loader to the correct position to refill the bucket.

Figure 2:
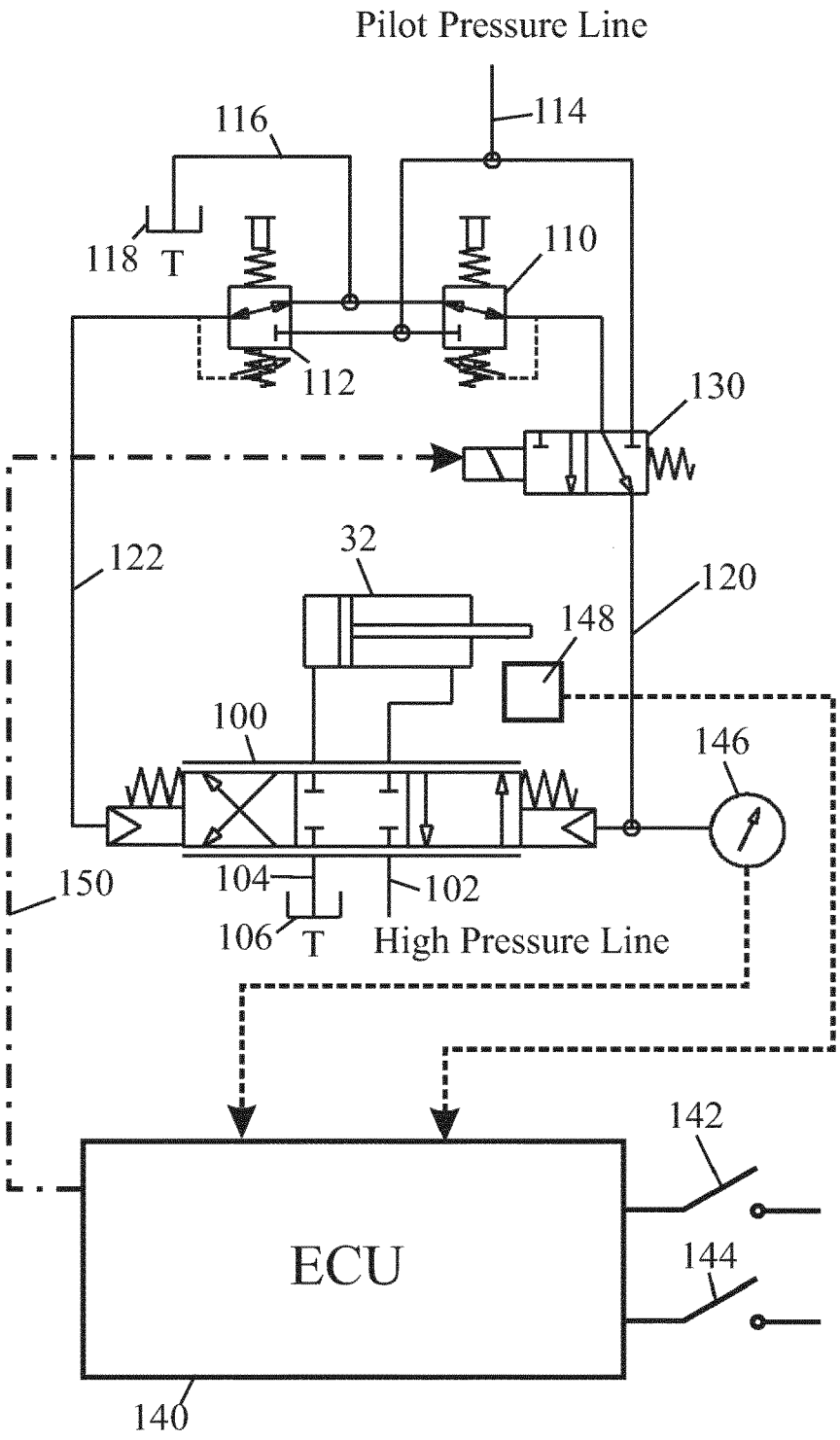
FIG. 2 is a schematic diagram of a control system having a return to dig functionality.

FIG. 2 shows a hydraulic control system for tilting cylinder that provides an RTD functionality. The tilting cylinder 32 has two working chambers acting on opposite sides of a piston that are connected by a proportional four-port, three-position pilot-operated valve 100 to a high pressure line 102 and a return line 104 leading back to a hydraulic reservoir 106. The valve 100 has spool biased to a central position where both of the working chambers are isolated to prevent any movement of the piston and thereby retain the bucket 18 in its current position.

The spool of the pilot-operated valve 100 is movable to the left and right by application of a pilot pressure that is less than the high pressure required to move the bucket. When the pilot pressure is applied to the right of the valve spool, it forces the spool to move to the left, as viewed causing high pressure to be applied to the chamber to the right of the piston of the cylinder 32 thereby retracting the cylinder 32 and causing the bucket 18 in FIG. 1 to tilt counter-clockwise. Conversely, applying pilot pressure to the left hand side of the spool causes the spool to move to the right, thus connecting the working chamber to let left of the piston to the high pressure line so as to extend the piston rod and cause the bucket 18 to rotate clockwise in FIG. 1.

The joystick mentioned previously acts either directly or by way of a suitable mechanical linkage on two proportional valves 110, 112 which can connect the control ports of the pilot-operated valve 100 to a pilot pressure supply line 114 or to a drain line 116 leading back to the hydraulic reservoir 118, which may be the same the reservoir 106. The valve 110 regulates the connection of the pilot pressure to the control to the right of the valve spool of the pilot-operated valve 100 to which it is connected by a line 120, while the valve 112 regulates the connection of the pilot pressure to the control to the left of the valve spool of the pilot-operated valve 100 to which it is connected by a line 122.

In the central position of the joystick, both control ports of the pilot-operated valve 100 are connected to the drain line 116 and all three of the valves 100, 110 and 112 adopt the illustrated position, in which both the working chambers of the tilting cylinder 32 are isolated to lock the piston rod in its current position. Movement of the joystick to one side will open the valve 110 to cause retraction of the tilting cylinder 32 by applying pilot pressure to the right hand side of the spool of the valve 100, and conversely movement of the joystick to the opposite side will open valve 112 and cause the tilting cylinder 32 to extend.

As so far the described, the hydraulic control system is entirely conventional and need not therefore be described in further detail.

The control system is however modified in the illustrated embodiment of the invention to provide an RTD functionality. This is achieved by the addition of a three-port, two position electrically operated valve 130, such as a solenoid valve, which, when actuated, bypasses the joystick operated proportional valve 110 and connects the control port of the pilot-operated valve 100 applying pressure to the right hand side of its valve spool directly to the pilot pressure line 114. Actuation of the valve 130 thereby acts to retract the tilting cylinder 32 and cause the bucket 18 to be tilted counter-clockwise in FIG. 1 from the position where its contents are tipped out into a truck to a horizontal position. This movement occurs regardless of the operation of the joystick and the position of the valve 110.

The actuation of the electrically-operated valve 130 is performed by a electronic control unit (ECU) 140 that is connected to receive various input signals. A first input signal is applied to the ECU by a panel mounted mode enabling switch. This switch is to activate or disable the RTD functionality and is analogous to the switch used in motor vehicles to activate cruise control. As long as the switch is off, the electrically-operated valve 130 remains permanently in its illustrated inoperative position.

A second input signal is applied to the ECU by a triggering switch 144, preferably activated by pressing a button mounted on the joystick. This switch, assuming all other conditions of the ECU 140 are satisfied, is activated to initiate an RTD operation.

A third input to the ECU is derived from a hydraulic pressure sensor 146 connected to the control line 120 leading to the right hand side control port of the pilot-operated valve 100 and a fourth input is derived from a position sensor 148 that informs the ECU 140 when the bucket 18 or the tilting cylinder has reached the desired RTD position.

After emptying the bucket into the truck, the operator initiates an RTD operation by actuating the switch 144 and moving the joystick in the direction to open the valve 110. On determining that the switch 144 has been operated to initiate an RTD operation, the ECU 140 checks to determine if a hydraulic pressure measured by pressure sensor 146 is in excess of a predetermined and calibratable value is present on the control line to confirm that the operator, in addition to pressing the joystick button that actuates the switch 144 has also moved the joystick in the direction to return the bucket to the desired position.

Once the conditions are satisfied the ECU 140 sends an output signal over a line 150 to activate the valve 130. Even though the operator may now release the joystick, the valve 130 will continue to apply pilot pressure to the control port of the pilot-operated valve to continue retracting the tilting cylinder 32. When the bucket reaches the desired RTD position, the position sensor 148 applies a signal to the ECU 140 which now disables the signal on the line 150 to return the valve 130 to the illustrated position in which the attitude of the bucket is once again under joystick control.

The operator may adjust the sensitivity of the system by changing the threshold value for the pressure in control line 120, measured by pressure sensor 146, that is considered by the ECU 140 to activate valve 130.

Figure 3:
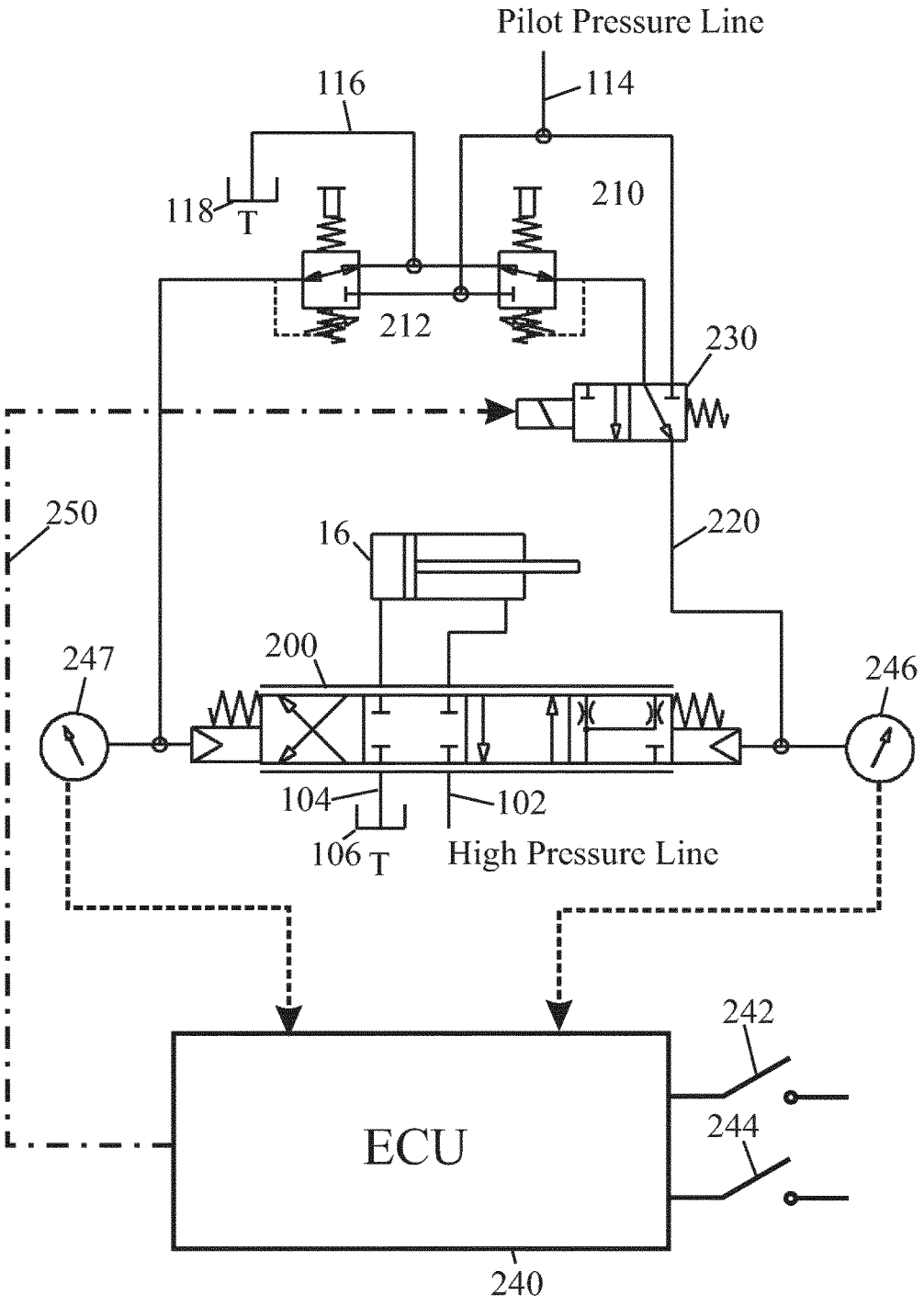
FIG. 3 is a schematic diagram of a control system having a return to float functionality.

The control system shown in FIG. 3 operates on the lifting cylinder 16 rather than the tilting cylinder 32 but has numerous similarities to the control system shown in FIG. 2. In this case, as well as allowing normal up and down control of the lifting arm 10 in FIG. 1 using the lifting cylinder 16, the control system provides an RTF functionality.

To avoid unnecessary repetition of the description, components that have already been described by reference to FIGS. 1 and 2 have been allocated the same reference numerals. Components that serve analogous functions to components that have been previously described and allocated reference numerals in the 100 series have been allocated corresponding reference numerals in the 200 series with the same two least significant digits. For example, in the same way as the valves 110 and 112 are operated by the sideways movements of the joystick to tilt the bucket 18, the valves 210 and 212 are operated by up and down movements of the joystick and serve to raise and lower the lifting arm 10. The ensuing description will therefore concentrate on the differences between the two control systems of FIGS. 2 and 3.

The most significant difference resides in the design of the pilot-operated valve 200. In this embodiment, in addition to the three positions of the valve 100 analogous to the positions of the valve 100 controlling the tilting cylinder 32, the valve 200 has a fourth position at the extreme right hand end of the valve spool in which both working chambers of the lifting cylinder 16 are connected to the drain line 104 through throttles. In this position, the valve 200 allows the lifting arm to float and the cylinder 16 acts only as a damper. It is to this position that the valve 200 has to be set in the RTF position. No sensor analogous to the sensor 148 is required as the floating position merely requires the movement of the spool of the pilot-operated valve 200 as far to the left as possible.

Once again, to send a signal over the line 250 to operate the electrically operated valve 230, the ECU 240 requires a mode selection switch 242 to be closed, a joystick mounted switch 244 to be actuated and a pressure to be sensed by the sensor 246 in the line 220 connecting the right hand side control port of the pilot-operated valve 200 to the joystick operated valve 210. However, when the listing arm is in the RTF operation, there is a risk of the bucket unexpectedly risking damage on its descent; for example if an person or an animal should happen to walk under the bucket. It is therefore important for the operator to be able to arrest the RTF operation and regain control of the lifting arm.

In the illustrated embodiment, this is achieved by a second hydraulic sensor 247 connected to a line leading from the joystick operated valve 212 to the control port at the left hand end of the pilot-operated valve. If the operator acts on the joystick in a direction to raise the lifting, resulting in the output signal of the sensor exceeding a preselected and calibratable level, then the ECU 240 immediately disables the signal on the line 250 that activates the electrically-operated valve 230.

It is of course possible for a working machine to have both an RTF and an RTD functionality. In this case the same mode switch may be used to enable both functionalities and the same joystick mounted switch can be used to trigger both functionalities as both functionalities also require a movement of the joystick and from the direction of movement of the joystick the ECU can determine whether to initiate an RTD operation, an RTF operation or both.

Of course, in a working machine having both RTD and RTF functionalities, the same ECU can be used for both functionalities and in this case the components 240, 242 and 244 could have been allocated reference number 140, 142 and 144, respectively.

By requiring a pressure to be sensed on the control line leading to the relevant pilot-operated valve, the invention avoids accidental initiation of an RTF or and RTD operation, as a joystick movement is required in addition to depression of a button. Furthermore, the invention allows a single switch on the joystick to initiate RTF and RTD operations, either consecutively or simultaneously, the latter requiring a diagonal movement of the joystick.

The invention claimed is:

1. A working machine comprising:

a movable implement;

a hydraulic actuator for displacing the implement; and a hydraulic control system for enabling an operator to control movement of the implement, the hydraulic control system comprising:

a high pressure supply line for supplying hydraulic fluid at a high pressure;

a pilot pressure supply line for supplying hydraulic fluid at a pilot pressure lower than the high pressure;

a hydraulic return line;

a pilot-operated valve for selectively connecting the high pressure supply line and the hydraulic return line to the hydraulic actuator to displace the implement, the pilot-operated valve comprising a spool movable by application of the pilot pressure;

a manually operable joystick;

a hydraulic pilot valve for regulating a supply of the pilot pressure to the pilot-operated valve based on a position of the joystick;

an electrically operated valve for bypassing the hydraulic pilot valve and supplying the pilot pressure to the pilot-operated valve independently of the position of the joystick; and an electrical circuit comprising a manually operable switch, the electrical circuit triggered by operation of the manually operable switch to initiate a return of the implement to a predetermined state by actuation of the electrically operated valve, independently of the position of the joystick; and a hydraulic pressure sensor connected to a line leading from the hydraulic pilot valve to the pilot-operated valve, the hydraulic pressure sensor configured to sense a pressure in the line, wherein the electrical circuit is only triggered by the operation of the manually operable switch when the pressure sensed by the hydraulic pressure sensor exceeds a predetermined value.

2. The working machine of claim 1, wherein the hydraulic control system further comprises a manually operable electrical mode switch connected to the electrical circuit to disable actuation of the electrically operated valve.

3. The working machine of claim 1, wherein the implement is a bucket of a loader and the hydraulic actuator serves to tilt the bucket, and wherein actuation of the electrically operated valve serves to perform a return to dig movement of the bucket.

4. The working machine of claim 3, wherein the control system further comprises a position sensor for sensing a position of the bucket, the position sensor configured to send a signal to the electrical circuit to disable the electrically operated valve in response to sensing that the bucket has returned to a desired position to recommence digging.

5. The working machine of claim 1, wherein the implement is a bucket mounted on a lifting arm and the hydraulic actuator is connected to the lifting arm to raise and lower the bucket, and wherein actuation of the electrically operated valve serves to displace the spool of the pilot-operated valve to a position in which the bucket is allowed to float, being free to fall under action of its own weight.

6. The working machine of claim 1, wherein sensitivity of the control system is changed by adjusting the predetermined value.

7. The working machine of claim 1, wherein the return of the implement to the predetermined state is disabled by re-actuation of the switch.

8. A working machine comprising:

a lifting arm;

a bucket mounted on the lifting arm;

a hydraulic actuator connected to the lifting arm to raise and lower the bucket; and a hydraulic control system for enabling an operator to control movement of the bucket, the hydraulic control system comprising:

a high pressure supply line for supplying hydraulic fluid at a high pressure;

a pilot pressure supply line for supplying hydraulic fluid at a pilot pressure lower than the high pressure;

a hydraulic return line;

a pilot-operated valve for selectively connecting the high pressure supply line and the hydraulic return line to the hydraulic actuator to raise and lower the bucket, the pilot-operated valve comprising a spool movable by application of the pilot pressure;

a manually operable joystick;

a hydraulic pilot valve for regulating a supply of the pilot pressure to the pilot-operated valve based on a position of the joystick;

an electrically operated valve for bypassing the hydraulic pilot valve and supplying the pilot pressure to the pilot-operated valve, actuation of the electrically operated valve serving to displace the spool of the pilot-operated valve to a position in which the bucket is allowed to float, being free to fall under action of its own weight; and an electrical circuit comprising a manually operable switch, the electrical circuit triggered by operation of the manually operable switch to initiate a return of the bucket to a predetermined state by actuation of the electrically operated valve, independently of the position of the joystick; and a hydraulic pressure sensor connected to a line leading from the hydraulic pilot valve to the pilot-operated valve, the hydraulic pressure sensor configured to sense a pressure in the line;

a joystick operated pilot valve; and a second hydraulic pressure sensor connected to a second line connecting the joystick operated pilot valve to the pilot-operated valve, the second hydraulic pressure sensor configured to sense a second pressure in the second line, wherein the electrical circuit is only triggered by the operation of the manually operable switch when the pressure sensed by the hydraulic pressure sensor exceeds a predetermined value and the electrically operated valve is disabled when the second pressure sensed by the second hydraulic pressure sensor in the second line exceeds a second predetermined value.

* * * * *